US008501146B2

(12) United States Patent
Choi et al.

(10) Patent No.: US 8,501,146 B2
(45) Date of Patent: Aug. 6, 2013

(54) PREPARATION METHOD FOR HOLLOW CARBON FIBER USING SUPERCRITICAL FLUID

(75) Inventors: Young-Ho Choi, Gyeonggi-do (KR); Do Suck Han, Gyeonggi-do (KR); Chi-Hoon Choi, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/397,008

(22) Filed: Feb. 15, 2012

(65) Prior Publication Data

US 2013/0133819 A1 May 30, 2013

(30) Foreign Application Priority Data

Nov. 30, 2011 (KR) ..... 10-2011-0126534

(51) Int. Cl.
*D01F 9/12* (2006.01)
*B32B 9/00* (2006.01)
*D02G 3/00* (2006.01)

(52) U.S. Cl.
USPC ..... 423/447.1; 423/447.2; 423/447.4; 423/447.6; 428/367; 428/397; 428/398; 264/29.2; 977/742

(58) Field of Classification Search
None
See application file for complete search history.

(56) References Cited

U.S. PATENT DOCUMENTS 4,382,837 A * 5/1983 Rutz ..... 117/99
6,135,987 A * 10/2000 Tsai et al. ..... 604/365
6,143,411 A * 11/2000 Ferguson ..... 428/398
6,261,677 B1 * 7/2001 Tsai et al. ..... 428/221
2011/0024939 A1 * 2/2011 Alves ..... 264/141

FOREIGN PATENT DOCUMENTS

JP 55045866 A 3/1980
JP 06316809 A 11/1994
KR 1991-0007558 9/1991
KR 10-2010-0098649 9/2010

OTHER PUBLICATIONS

Ismail et al.; Post Spinning and Pyrolysis Processes of Polyacrylonitrile (PAN)-based Carbon Fiber and Activated Carbon Fiber; A Review; Journal of Analytical and Applied Pyrolysis; 91, pp. 1-13; Oct. 15, 2011.*
Hu et al.; Molecular Weight Distribution of Polyacrylonitrile Produced in Supercritical Carbon Dioxide; Journal of Applied Polymer Science; vol. 86, issue 9, pp. 2338-2341; Sep. 18, 2002.*
Baird et al.; Absorption of Carbon Dioxide and Subsequent Viscosity Reduction of an Acrylonitrile Copolymer; Polymer; 45, pp. 3399-3412; 2004.*

* cited by examiner

*Primary Examiner* — Guinever Gregorio
(74) *Attorney, Agent, or Firm* — Edwards Wildman Palmer LLP; Peter F. Corless

(57) ABSTRACT

Disclosed is a method for preparing hollow carbon fibers having an empty space in the cross section thereof. More specifically, the disclosed method includes melt-spinning an acrylonitrile-based polymer by using a supercritical fluid as a plasticizer; drawing spun fibers to prepare hollow precursor fibers; and stabilizing and carbonizing the hollow precursor fibers to prepare the hollow carbon fibers. The hollow carbon fibers obtained by the disclosed method have at least a 10 to 50% lower specific gravity than conventional hollow carbon fibers (solid), but have similar mechanical properties to the conventional fibers. Furthermore, the diameter of carbon fibers can be adjusted, thereby making it possible to widen the application of hollow carbon fibers.

6 Claims, 1 Drawing Sheet

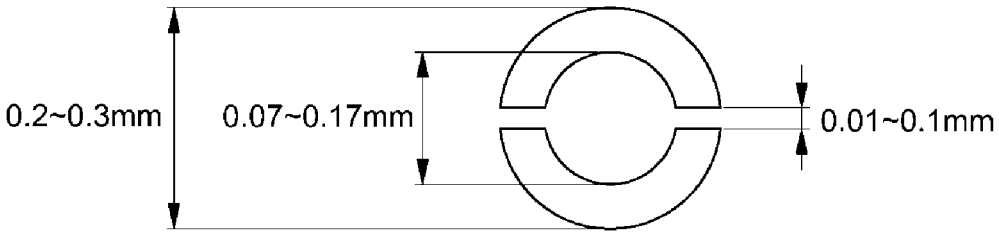
0.2~0.3mm
0.07~0.17mm
0.01~0.1mm

PREPARATION METHOD FOR HOLLOW CARBON FIBER USING SUPERCRITICAL FLUID

CROSS-REFERENCE TO RELATED APPLICATION

This application claims under 35 U.S.C. §119(a) the benefit of Korean Patent Application No. 10-2011-0126534 filed on Nov. 30, 2011, the entire contents of which are incorporated herein by reference.

BACKGROUND (a) Technical Field

The present invention relates to a method for efficiently preparing hollow carbon fibers having an empty space in the cross section thereof by using a supercritical fluid.

(b) Background Art

As concerns about the exhaustion of petroleum resources, and environmental effects increase worldwide, the requirement for fuel efficiency enhancement of vehicles increased as well. In order to satisfy this requirement, a method for reducing the weight of a vehicle has an interest in the automotive community. Out of this interest, carbon fiber composites have immerged as an efficient way of increase fuel economy. In the carbon fiber composite, a carbon fiber supporting an external load has a higher specific gravity than a resin as a parent material. Thus, if the strength of a carbon fiber is maintained, and the specific gravity of the carbon fiber is reduced, weight reduction can be achieved with great effects.

For weight reduction of carbon fibers, research related to development of hollow carbon fibers having an empty space in the cross section thereof has been conducted. Conventionally, when preparing hollow carbon fibers, a fluid is fed into the center of a spinneret during spinning of precursor fibers so as to prepare hollow fibers, and the fibers are stabilized and carbonized so as to prepare hollow carbon fibers. [U.S. Pat. Nos. 5,338,605, and 4,358,017]

However, this method is inefficient because it requires high energy consumption for using and collecting the fluid (gas, liquid). In the most frequently used acrylonitrile copolymer precursor fibers, the fed fluid increases the solidification speed of an extruded spinning solution. Thus, it is difficult to produce carbon fibers with a high strength, and to produce carbon fibers having a diameter appropriate for use as a structural reinforcement. The carbon fibers produced via this method are in most cases used for heat insulation.

Furthermore, it is difficult to melt-spin the acrylonitrile polymer because the polymer has a melting temperature which is lower than a decomposition temperature. Thus, the acrylonitrile polymer is limitedly applied to the production of fibers for clothes through melt spinning using a plasticizer such as water. However, when the water assisted melt-spun acrylonitrile polymer is used as a carbon fiber precursor to produce a composite, these carbon fibers have a low mechanical strength. Thus, it is inappropriate to use the acrylonitrile polymer plasticized with water as a reinforcement member.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention provides an improved method for preparing hollow carbon fibers which exhibit excellent strength and rigidity, and may advantageously be used as a weight reduction method for a structural frame due to its low apparent specific gravity.

More specifically, the present invention provides a method for preparing hollow carbon fibers which includes melt-spinning an acrylonitrile-based polymer by using a supercritical fluid as a plasticizer; drawing spun fibers to prepare hollow precursor fibers; and stabilizing and carbonizing the precursor fibers to prepare the hollow carbon fibers.

The inventive method has the following advantages over a conventional hollow carbon fiber preparation method.

1. The fibers have at least a 10 to 50% lower specific gravity by than conventional hollow carbon fibers (solid). Thus, they are very advantageous in view of the weight reduction when used, together with a plastic resin, as a structural frame for cars, aircrafts, etc.

2. Unlike conventional hollow carbon fibers, these fibers can be used for producing a carbon fiber composite showing a very high flexural rigidity with respect to the weight.

3. The conventional hollow carbon fiber preparation method has a limitation in its application because the prepared carbon fibers have a very large carbon fiber cross section. On the other hand, in the preventive preparation method, it is possible to prepare carbon fibers having a more desirable (smaller) diameter.

4. In the conventional hollow carbon fiber preparation method, a secondary fluid is used during a spinning process. Thus, expensive spinning facilities and a fluid collecting process are required. On the other hand, in the preventive method, since only a spinneret (nozzle) is required to be changed, the production unit cost can be reduced.

5. In the conventional melt spinning using water as a plasticizer, it is difficult to spin an acrylonitrile-based polymer with a high molecular weight. On the other hand, in the inventive method, since a supercritical fluid is used as a plasticizer, it is possible to spin an acrylonitrile-based polymer with a high degree of polymerization. The illustrative embodiment of the present invention, however, produces carbon fibers with a high mechanical strength.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein:

FIG. 1 is a schematic cross sectional view showing a spinneret used in the preparation method according to an exemplary embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g., fuels derived from resources other than petroleum).

Ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Hereinafter, the inventive preparation method of hollow carbon fibers will be described in more detail by steps.

The first step in the exemplary embodiment of the present invention is to melt-spin an acrylonitrile-based polymer by using a supercritical fluid as a plasticizer. The acrylonitrile-based polymer used in the present invention is a polymer obtained by polymerizing acrylonitrile monomers as a main component, and may have a weight average molecular weight (Mw) ranging from about 100,000 to 1,000,000 g/mol, preferably ranging from 200,000 to 500,000 g/mol. Especially, in the exemplary embodiment of the present invention, it is possible to melt spin a high molecular weight-acrylonitrile-based polymer. In the acrylonitrile-based polymer used in the exemplary embodiment of the present invention, the acrylonitrile units are included in an amount of about 90 wt % or more, preferably of 95 wt % or more, with respect to the total polymer weight. When the acrylonitrile units are included in an amount of less than 90 wt %, the crystal structures of a carbon fiber precursor and carbon fibers are not sufficiently developed. This may reduce the strength and the rigidity of the carbon fibers. Thus, it is preferable that the content of the units is at least 90 wt %. Also, the acrylonitrile-based polymer may be a copolymer obtained by copolymerizing the above mentioned monomers with other monomers. In this case, it is preferable that the content of the acrylonitrile units is at least about 90 wt %. As a monomer capable of being copolymerized, one or more may be selected from the group including acrylic acid (AA), methacrylic acid (MA), itaconic acid (IA), methacrylate (MA), and acrylamide (AM).

The acrylonitrile-based polymer is melt-spun by passing through an extruder connected to a supply device of a supercritical fluid. Herein, the supercritical fluid may be selected from the group including carbon dioxide ($CO_2$), methanol ($CH_3OH$), ethanol ($C_2H_5OH$), and propylene ($C_3H_6$). As a spinneret, a conventional spinneret for hollow fibers is used. The spinneret used in the present invention is shown in FIG. 1, which has a hollow outer diameter ranging from about 0.2 to 0.3 mm, a hollow inner diameter ranging from about 0.07 to 0.17 mm, and a spinneret interval ranging from about 0.01 to 0.1 mm.

The second step in the exemplary embodiment of the present invention is to produce hollow precursor fibers by drawing the spun fibers. As-spun fibers obtained from the spinning step have a large cross section, and thus it is difficult to use them as a structural reinforcement member. Accordingly, in the exemplary embodiment of the present invention, a drawing step is carried out to adjust the thickness of the hollow carbon fibers. The drawing step may be carried out according to a conventional method. Specifically, the hollow precursor fibers extruded from the spinneret are cooled at room temperature (e.g., ranging from about 15 to 30° C.), and then drawn and wound by using a Godet roller (e.g., 150 to 170° C.) through a continuous process.

The third step in the exemplary embodiment of the present invention is to produce the inventive hollow carbon fibers by stabilizing and carbonizing the hollow precursor fibers. In the exemplary embodiment of the present invention, in the stabilizing step, the precursor fibers are heat-treated under an oxidizing atmosphere at a temperature ranging from about 200 to 350° C. and preferably from 250 to 330° C. The stabilizing time depends on the thickness of precursor fibers, and the component copolymerized with the acrylonitrile-based polymer. Homo-acrylonitrile precursor fibers (e.g., 10 μm in diameter) require a stabilizing time ranging from about 2 to 4 hours.

More specifically, in the stabilizing step, the precursor fibers are stabilized by being exposed under an oxidizing atmosphere at a temperature ranging from about 200 to 280° C. and preferably at a temperature of 250° C. for 1 to 3 hours, and then under an oxidizing atmosphere at a temperature ranging from about 300 to 350° C. and preferably at a temperature of 320° C. for about 20 to 50 minutes. In the hollow precursor fibers obtained after the stabilizing step, a heat/chemical stable ladder-shaped chemical structure is formed. Herein, when the stabilization temperature is less than 200° C., the stabilization may be incompletely carried out, on the other hand, when the stabilization temperature is greater than 350° C., the reaction may be suddenly carried out, thereby reducing the mechanical strength of carbon fibers.

In the present invention, in the carbonizing step, the stabilized fibers are heat-treated under an inert atmosphere (argon, nitrogen) at a temperature ranging from about 1000 to 1800° C. and preferably at a temperature ranging from 1000 to 1500° C. for about 1 to 25 minutes and preferably 5 to 10 minutes. Then, most components except for carbon are volatilized, and carbon fibers with a honeycomb structure are prepared. The prepared carbon fibers may be, as required, graphitized by being additionally heat-treated under an inert atmosphere (argon) at a temperature ranging from about 2000 to 2800° C. and preferably ranging from 2300 to 2800° C. for about 10 to 30 minutes.

In the stabilization, the carbonization, and the graphitization, the temperature-rising speed is maintained at about 2 to 7° C./min, preferably at 3 to 5° C./min, and especially preferably at 5° C./min. The inside temperature of a heat treating furnace may be differently set for the start running point and the end running point of fibers so as to adjust the temperature-rising speed. In order to prevent the fibers from shrinking, the speed of the roller within the heat treating furnace is adjusted in such a manner that the tension can be maintained in a range from about 0.5 to 2 gf/filament.

The present invention will be described in more detail with reference to following Examples, but is not limited thereto.

EXAMPLES

The following examples illustrate the invention and are not intended to limit the same.

Example 1

Carbon dioxide (a supercritical fluid) was used as a plasticizer so as to melt-spin an acrylonitrile polymer (Mw 300,000 g/mol) at 150° C. As a spinneret, the spinneret (hollow outer diameter: 0.25 mm, hollow inner diameter: 0.1 mm, spinneret interval: 0.05 mm) shown in FIG. 1 was used. The fibers extruded through spinning were solidified by air (20° C.), and then drawn at 170° C. so as to produce hollow precursor fibers. The hollow precursor fibers were heat-treated at 250° C. for 2 hours by raising the temperature at a temperature-rising speed of 5° C./min under dehumidifying air, and then heat-treated at 320° C. for 20 minutes. The stabilized fibers were carbonized at 1300° C. for 5 minutes by raising the temperature at a temperature-rising speed of 5° C./min under nitrogen atmosphere so as to prepare hollow carbon fibers.

Comparative Example 1

Carbon fibers were produced by melt spinning inside-filled precursor fibers having the same outer diameter as the precursor fibers produced in Example 1.

Comparative Example 2

The inside-filled precursor fibers obtained from Comparative Example 1 were heated at 250° C. for 2.5 hours, at 320° C. for 40 minutes by raising the temperature at a temperature-rising speed of 5° C./min under dehumidifying air. Then, the stabilized fibers were carbonized at 1300° C. for 5 minutes by raising the temperature at a temperature-rising speed of 5° C./min under nitrogen atmosphere so as to produce inside-filled carbon fibers (Solid).

Comparative Example 3

Hollow carbon fibers were produced in the same manner as described in Example 1, except that as a plasticizer, water was used instead of carbon dioxide.

Comparative Example 4

By using a composite spinning (core-shell) device disclosed in International Patent Publication WO 2009/049174, formamide was spun in the core as disclosed in U.S. Pat. No. 4,385,017. As-spun fibers were stabilized and carbonized under the same condition as described in Example 1 so as to produce hollow carbon fibers.

Properties of carbon fibers obtained from Example 1 and 2 and Comparative Examples 1 to 4 were measured and noted in Table 1 below.

TABLE 1

| | | Comparative Example | | | |
|---|---|---|---|---|---|
| index | Example 1 | 1 | 2 | 3 | 4 |
| tensile strength (GPa) | 3.2 | 2.9 | 3.6 | 1.6 | 0.9 |
| tensile modulus (GPa) | 213 | 199 | 221 | 175 | 96 |
| outer diameter (μm) | 7.2 | 7.4 | 7.0 | 7.9 | 47 |
| apparent specific gravity | 1.58 | 1.78 | 1.79 | 1.66 | 0.87 |
| crystal size (nm) | 1.4 | 1.0 | 1.5 | 1.2 | — |

tensile strength, tensile modulus: in accordance with ASTM D4018.

In hollow carbon fibers, a cross section includes a hollow portion.

Crystal size is calculated by substituting a FWHM (Full Width at Half Maximum) value of a peak at 2θ≈3° in a equatorial-directional integral graph from an XRD (Wide angle) diffraction image of carbon fibers into Scherrer's equation.

As noted in Table 1, as compared to fibers from Comparative Example 2 as conventional carbon fibers (solid), fibers from Example 1 showed a lower apparent specific gravity by at least 12%. In other words, the inventive hollow carbon fibers have a lower specific gravity than conventional carbon fibers (solid). Thus, they show an increase in weight reduction, and also are useful for fabricating carbon fiber composites. This is because the reduction of a mechanical strength is not in proportion to an empty space size of carbon fibers used in the composite. In other words, in the stabilizing step in the production of carbon fibers, the route required for oxygen diffusion becomes shorter, which makes it possible to efficiently develop a crystal structure.

Also, by comparing hollow carbon fibers from Example 1 to carbon fibers (solid) from Comparative Example 2 in view of mechanical strength, it was found that the fibers from Example 1 have the same properties as Comparative Example 2. Thus, it is possible to produce carbon fibers having a low specific gravity and a high mechanical strength. Especially, since the stabilization time of Example 1 is at least 45 minutes shorter than that of Comparative Example 2, it can be found that the preventive method requires a lower cost with higher efficiency than Comparative Example 2.

Furthermore, the final carbon fibers from Comparative Example 1 have significantly lower mechanical properties than fibers from Example 1 or Comparative Example 2 because they have an insufficiently developed crystal structure due to incomplete stabilization. Also, as compared to fibers obtained by using a supercritical fluid, from Example 1, conventional fibers obtained by using water as a plasticizer, from Comparative Example 3, showed reduced mechanical properties. Even further, carbon fibers obtained from Comparative Example 4 have a large outer diameter and low mechanical properties as well. Thus, it is difficult to use them as a reinforcement member of a composite.

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

What is claimed is:

1. A method for preparing hollow carbon fibers, the method comprising:

melt-spinning an acrylonitrile-based polymer having a weight average molecular weight ranging from 200,000 to 500,000 g/mol by using a supercritical fluid as a plasticizer;

drawing spun fibers to prepare hollow precursor fibers; and stabilizing and carbonizing the hollow precursor fibers to prepare the hollow carbon fibers, wherein a spinneret used for the melt-spinning has a hollow outer diameter ranging from 0.2 to 0.3 mm, a hollow inner diameter ranging from 0.07 to 0.17 mm, and a spinneret interval ranging from 0.01 to 0.1 mm.

2. The method as claimed in claim 1, wherein the acrylonitrile-based polymer comprises acrylonitrile units in an amount of 90 wt % or more with respect to a total polymer weight.

3. The method as claimed in claim 1, wherein the supercritical fluid is selected from the group consisting of carbon dioxide ($CO_2$), methanol ($CH_3OH$), ethanol ($C_2H_5OH$), and propylene ($C_3H_6$).

4. The method as claimed in claim 1, wherein in stabilizing the precursor fibers, the precursor fibers are heat-treated under an oxidizing atmosphere at a temperature ranging from 200 to 350° C.

5. The method as claimed in claim 1, wherein in carbonizing the precursor fibers, the precursor fibers are heat-treated under an inert atmosphere at a temperature ranging from 1000 to 1800° C.

6. The method as claimed in claim 1, further comprising graphitizing the carbonized fibers through heat-treatment under an inert atmosphere at a temperature ranging from 2000 to 2800° C.

* * * * *